US009403268B1

(12) United States Patent
Nihra et al.

(10) Patent No.: US 9,403,268 B1
(45) Date of Patent: Aug. 2, 2016

(54) RETAINING MECHANISM FOR TELESCOPIC SHAFT

(71) Applicants: Thomas E. Nihra, Oldsmar, FL (US); Deni H. Nihra, Oldsmar, FL (US)

(72) Inventors: Thomas E. Nihra, Oldsmar, FL (US); Deni H. Nihra, Oldsmar, FL (US)

( * ) Notice: Subject to any disclaimer, the term of this patent is extended or adjusted under 35 U.S.C. 154(b) by 0 days.

(21) Appl. No.: 14/635,434

(22) Filed: Mar. 2, 2015

(51) Int. Cl.
*A63B 47/02* (2006.01)
*B25G 1/04* (2006.01)

(52) U.S. Cl.
CPC .. *B25G 1/04* (2013.01); *A63B 47/02* (2013.01)

(58) Field of Classification Search
CPC ..... B25G 1/04
USPC ..... 294/19.2; 463/47.7; 473/319; 16/429, 16/405, 427
See application file for complete search history.

(56) References Cited

U.S. PATENT DOCUMENTS 2,298,140 A * 10/1942 Mace ..... H01Q 1/10 116/173
3,515,418 A * 6/1970 Nielsen, Jr. ..... A61B 5/021 248/188.5
4,508,467 A * 4/1985 Choffin ..... A01K 87/02 294/210
4,659,125 A * 4/1987 Chuan ..... A63B 47/02 16/429
4,896,687 A * 1/1990 Segal ..... A45B 9/00 135/141
5,460,458 A * 10/1995 Caceres ..... B25G 1/04 16/429
5,538,354 A * 7/1996 Simond ..... F16B 7/1463 280/819
5,568,922 A * 10/1996 Siddle ..... F41B 15/025 463/47.7
5,692,856 A * 12/1997 Newman, Jr. ..... B25G 1/04 403/109.5
5,836,620 A * 11/1998 Wang ..... F16L 27/12 285/302
6,045,288 A * 4/2000 Pasternak ..... F16B 7/14 294/19.2
7,073,228 B2 7/2006 Light
2008/0253600 A1 * 10/2008 Wetzel ..... F16B 7/14 381/362

* cited by examiner

*Primary Examiner* — Paul T Chin
(74) *Attorney, Agent, or Firm* — David L. Oppenhuizen; Oppenhuizen Law PLC

(57) ABSTRACT

A telescoping handle including a plurality of telescoping hollow tubes that are nested within each other and dimensioned to provide a gap between each adjacent pair of nested tubes. At least one shim is secured to the outer circumferential surface of one end of at least one of the tubes. The shim has a thickness sufficient to fill the gap between the adjacent pair of tubes whereby the shim is flush against the inner surface of the adjacent hollow tube. The other end of an adjacent tube has a tapered portion which has an inner circumferential surface that is flush against the outer circumferential surface of the adjacent telescoping tube.

10 Claims, 5 Drawing Sheets

RETAINING MECHANISM FOR TELESCOPIC SHAFT

BACKGROUND OF THE INVENTION

1. Field of the Invention

The present invention pertains to a telescopic shaft for a golf ball retriever. More particularly, the present invention pertains to a telescopic shaft for a golf ball retriever including shims positioned between the tubes to add rigidity to the telescopically-extended golf ball retriever.

2. Description of the Prior Art

Golf ball retrievers having a telescopically-extendable handle is well-known in the art. These telescopically-extendable handles include a plurality of hollow tubular members which are nested within each other. In order to allow the tubes to be extended and retracted with ease, a slight gap must be provided between each pair of concentrically-positioned adjacent tubes. However, the gaps between each pair of adjacent tubes allows the entire handle to flex under its own weight while in a fully-extended position. More specifically, the adjacent tubes flex primarily at the joints between each pair of adjacent tubes due to the gap between the tubes that is inherently required to allow the tubes to be slidingly-engaged with each other. This flex makes the golf ball retriever more difficult to manipulate and use. Thus, the objective is to provide a golf ball retriever which is light yet rigid, and is also easily extendable.

One attempt in the prior art to overcome this problem is disclosed in U.S. Pat. No. 7,073,228 to Light. Light provides a cap which is placed in the end of each telescopic tube. The cap is said to provide a high degree of stiffness to the handle. Consequently, this allows the handle to be made with shorter tubes yet achieve the same maximum extended length as a handle which does not include the caps. However, this solution requires additional parts by way of the caps and a C-clip necessary to lock each into cap into the end of each tube. These additional parts add to the overall weight of the handle and also inevitably make the handle more expensive due to the additional material costs and additional manufacturing time required to assemble these additional parts.

Thus, there remains a need for a telescoping handle for a golf ball retriever which is light, easy to manufacture, and requires few additional parts, yet which is structurally-reinforced so that it is sufficiently rigid while in an extended state.

The present invention, as detailed hereinbelow, seeks to fill this need by providing a telescopic shaft for a golf ball retriever including shims positioned between the tubes.

SUMMARY OF THE INVENTION

The present invention provides a telescoping handle comprising: (a) a plurality of telescoping hollow tubes, each tube having a first end, a second end, and an outer circumferential surface, the telescoping hollow tubes being nested within each other and being dimensioned to provide a gap between each adjacent pair of nested tubes; (b) at least one shim secured to the outer circumferential surface of the first end of at least one of the tubes, the shim having a curvature to match the outer surface of the tube such that the shim and the outer surface are flush, and the shim has a thickness sufficient to fill the gap between the adjacent pair of tubes whereby the shim is flush against the inner surface of the adjacent hollow tube; (c) the second end of at least one of the tubes having a tapered portion, the tapered portion having an inner circumferential surface that is flush against the outer circumferential surface of the adjacent telescoping tube; and (d) whereby the first end of an inner tube in a pair of adjacent tubes cannot slide beyond the second end of the outer adjacent tube because the shim on the inner tube and the tapered portion on the outer tube abut each other in a fully telescopically-extended position.

Optionally, the tapered portion is at least 2 millimeters long and the shim is at least 5 millimeters long. Preferably the tapered portion is about 2-4 millimeters long and the shim is preferably about 5-15 millimeters long.

Optionally the telescoping handle has two shims secured to the first end of at least one of the telescoping tubes, and the shims are evenly spaced about the outer circumference of the telescoping tube.

Optionally, the telescoping handle includes at least three telescoping tubes, and the three telescoping tubes form two pairs of adjacent nested tubes. The outer-most tube and the medially-positioned tube form a first pair of adjacent nested tubes, and the inner-most tube and the medially-positioned tube form a second pair of adjacent nested tubes.

Optionally, the shim can have a cylindrical section that fully surrounds the outer circumference of the telescoping tube.

According to a second embodiment hereof, there is provided a telescoping handle comprising: (a) a plurality of telescoping hollow tubes, each tube having a first end, a second end, and an outer circumferential surface, the telescoping hollow tubes are nested within each other and are dimensioned to provide a gap between each adjacent pair of nested tubes; (b) at least one shim secured to the outer circumferential surface of the first end of at least one of the tubes, the shim having a curvature to match the outer surface of the tube such that the shim and the outer surface are flush, and the shim has a thickness sufficient to fill the gap between the adjacent pair of tubes whereby the shim is flush against the inner surface of the adjacent hollow tube; (c) the second end of at least one of the tubes has at least two inwardly-oriented beads, one of the inwardly-oriented beads is positioned at an end of the second end of the tube, and one of the inwardly-oriented beads is positioned on the second end of the tube but not on the end, the inwardly-oriented beads having an inner circumferential surface that is flush against the outer circumferential surface of the adjacent telescoping tube.

According to this embodiment, the shim is preferably at least 5 millimeters long, and even more preferably the shim is about 7-18 millimeters long.

Optionally, one of the inwardly-oriented beads is positioned about 5-15 millimeters from the end of the second end of the tube.

Optionally, the first end of at least one of the tubes includes an outwardly-oriented bead. The outwardly-oriented bead has an outer circumferential surface that is flush against the inner circumferential surface of the adjacent telescoping tube.

For a more complete understanding of the present invention, reference is made to the following detailed description and accompanying drawings. In the drawings, like reference characters refer to like parts throughout the views in which:

DETAILED DESCRIPTION OF THE PREFERRED EMBODIMENT

Figure 1:
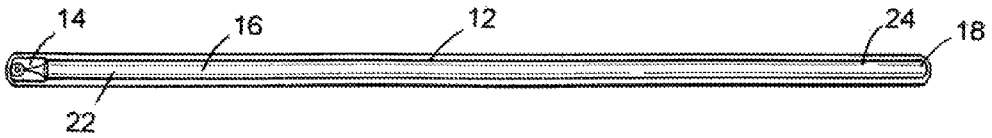
FIG. 1 is a front side view of a tube from the telescoping handle according to a first embodiment of the present invention hereof.
Figure 2:
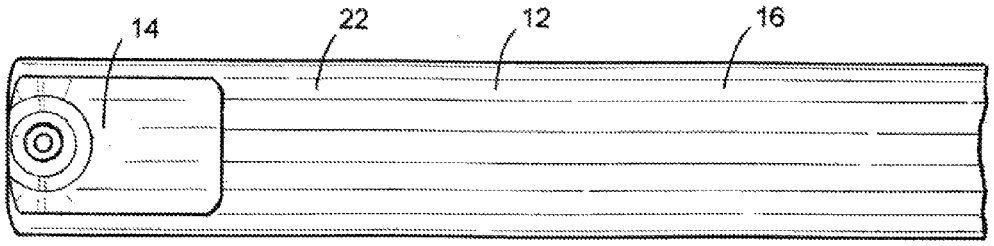
FIG. 2 is an enlarged view showing the first end of the tube shown in FIG. 1.

In accordance with the present invention and as shown generally in FIG. 1, there is provided a telescoping handle 10 comprising: (a) a plurality of telescoping hollow tubes 12; (b) at least one shim 14 secured to the outer circumferential surface 16 of at least one of the tubes 12; (c) at least one of the tubes 12 has a tapered portion 18 which has an inner circumferential surface 20 that is flush against the outer circumferential surface 16 of the adjacent telescoping tube 12; and (d) whereby a first end 22 of an inner tube 12 in a pair of adjacent tubes 12 cannot slide beyond the second end 24 of the outer adjacent tube 12 because the shim 14 on the inner tube 12 and the tapered portion 18 on the outer tube 12 abut each other in a fully telescopically-extended position.

Figure 4:
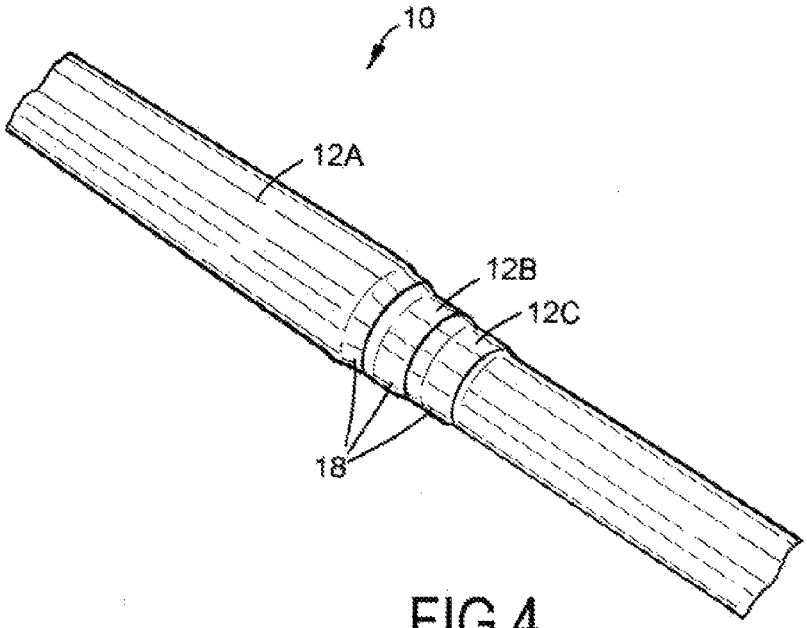
FIG. 4 is an enlarged perspective view showing four tube members, three of which are shown in a retracted position.
Figure 5:
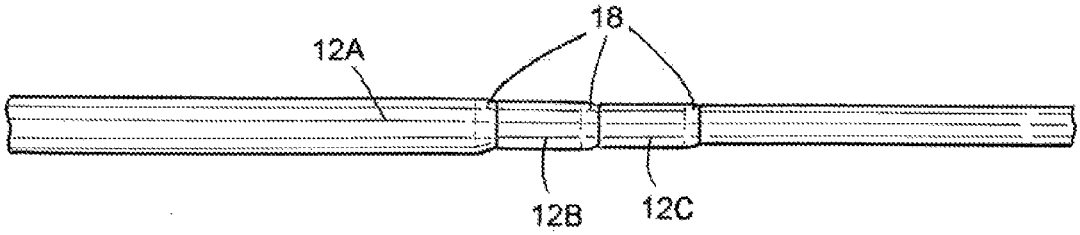
FIG. 5 is a front side view showing four tube members, three of which are shown in a retracted position.

As shown in FIGS. 4 and 5, the telescoping handle 10 includes a plurality of telescoping hollow members, or tubes 12. The hollow tubes 12 are nested within each other and are dimensioned to provide a gap between each adjacent pair of nested tubes 12. The tubes 12 are formed from any suitable type of material that is well-known in the art for a telescoping handle 10 for a golf ball retriever. Preferably the tubes 12 are formed from metal, and even more preferably the tubes 12 are formed from aluminum, stainless steel, or any other type of metal that is corrosion-resistant in the presence of water.

Optionally, the telescoping handle 10 includes at least three telescoping tubes 12 in which the three telescoping tubes 12 form two pairs of adjacent nested tubes 12. To illustrate this point, and shown in FIGS. 4 and 5, the outer-most tube 12A and the medially-positioned tube 12B form a first pair of adjacent nested tubes 12, and the inner-most tube 12C and the medially-positioned tube 12B form a second pair of adjacent nested tubes 12. Any suitable number of tubes 12 may be provided to increase the length of the telescoping handle 10. However, as discussed above, a finite limitation is approached as the number of tubes 12 continues to increase because the handle 10 will flex under its own weight which makes the golf ball retriever difficult (and eventually impossible) to use. Each of the tubes 12 has a first end 22, a second end 24, an outer circumferential surface 16, and an inner circumferential surface 20.

At least one shim 14 is secured to the outer circumferential surface 16 of the first end 22 of at least one of the tubes 12. The shim 14 is a thin piece of material, such as a spacer, and the shim 14 is preferably generally rectangular in shape. The shim 14 is formed from any suitable type of material like metal or plastic. The shim 14 can be secured to the tube 12 using any suitable means, such as an adhesive or a mechanical connection. Preferably the shim 14 is formed from metal and secured to the tube 12 using a mechanical connection like a rivet or a crimp.

The shim 14 has a curvature to match the outer surface of the tube 12 so that the shim 14 and the outer surface of the tube 12 are flush with each other. The shim 14, being curved and rectangular, preferably forms a partially-cylindrical surface. The shim 14 has a thickness sufficient to fill the gap between the adjacent pair of tubes 12 whereby the shim 14 is flush against the inner surface 20 of the adjacent hollow tube 12. According to this embodiment, the shim 14 is preferably at least 5 millimeters long. And more preferably, the shim 14 is about 5-15 millimeters long.

Although the tube 12 and shim 14 have been described thus far as only a single shim 14 being used, preferably at least one of the tubes 12 has two shims 14 or more secured to the first end 22 thereof. Preferably the shims 14 are evenly spaced about the outer circumferential surface 16 of the telescoping tube 12. Alternatively, and although not shown in the drawings, the shim 14 can be cylindrical in shape and have a cylindrical section that fully surrounds the outer circumference of the telescoping tube 12.

Figure 3:
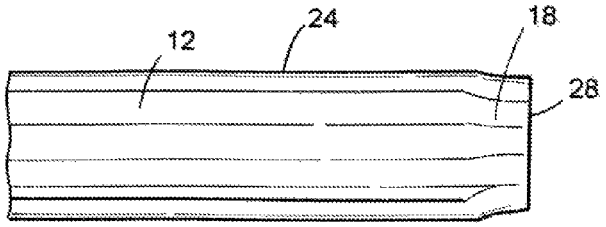
FIG. 3 is an enlarged view showing the second end of the tube shown in FIG. 1.

As shown in FIG. 3, the second end 24 of at least one of the tubes 12 has a tapered portion 18 having a diameter that is narrower than the remaining portion of the tube 12. The tapered portion 18 is formed using any suitable type of metal working technique or process that is well-known in the art. The tapered portion 18 has an inner circumferential surface 20 that is flush against and around the outer circumferential surface 16 of the adjacent telescoping tube 12. In order to help add rigidity to the joint with the inner adjacent tube 12, the tapered portion 18 is preferably at least 2 millimeters long. More preferably, the tapered portion 18 is about 2-4 millimeters long.

Figure 6:
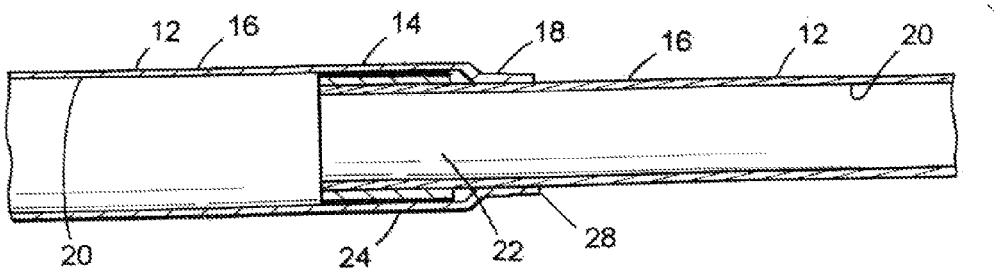
FIG. 6 is a cross-sectional view showing an inner tube and an outer tube from an adjacent pair of tubes, the inner and outer tubes being in an extended position.
Figure 7:
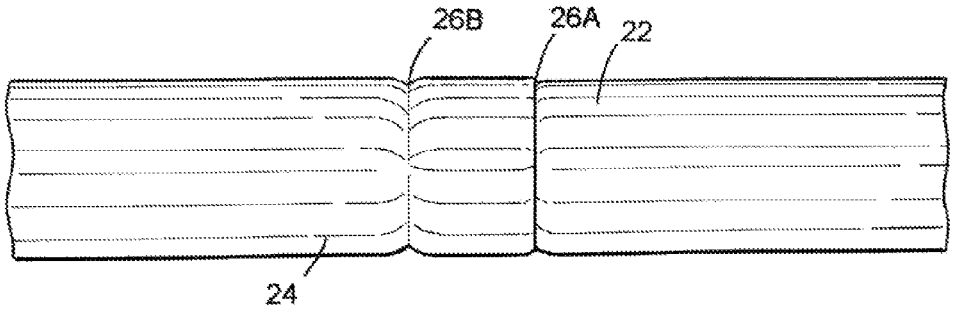
FIG. 7 is an enlarged view showing the second end of a tube according to a second embodiment of the invention.
Figure 8:
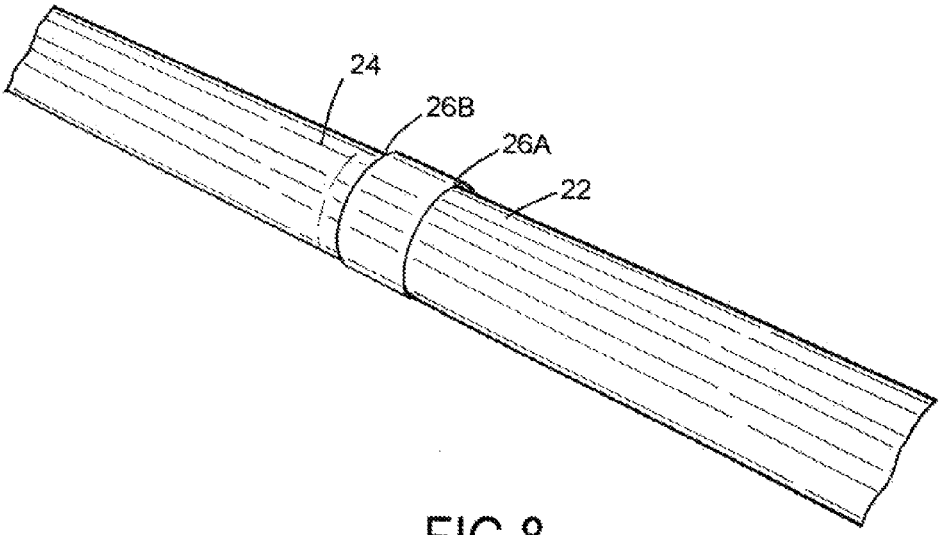
FIG. 8 is a perspective view showing the second end of a tube according to the second embodiment of the invention.
Figure 9:
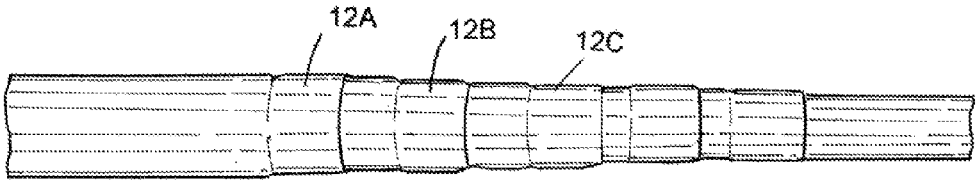
FIG. 9 is an enlarged view showing a plurality of tube in a retracted position.

As shown in FIG. 6, the first end 22 of an inner tube 12 in a pair of adjacent tubes 12 cannot slide beyond the second end 24 of the outer adjacent tube 12 because the shim 14 on the inner tube 12 and the tapered portion 18 on the outer tube 12 abut each other in a fully telescopically-extended position. Furthermore, the shim 14 and the tapered portion 18 each function to eliminate the gap between the adjacent tubes 12 in the manner described above. To that end, the tapered portion 18 and the shim 14 work in conjunction to provide a rigid joint between the adjacent pair of tubes 12 because both the shim 14 and the tapered portion 18 provide a flush mating surface (and without a gap) between the inner circumferential surface 20 of the outer tube 12 and the outer circumferential surface 16 of the inner tube 12 in a pair of adjacent tubes 12.

According to a second embodiment, and as shown generally in FIGS. 7-11, there is provided a telescoping handle 10 comprising: a plurality of telescoping hollow tubes 12; at least one shim 14 secured to the outer circumferential surface 16 of the first end 22 of at least one of the tubes 12; and at least two inwardly-oriented beads 26A,26B positioned on at least one of the tubes 12.

Figure 11:
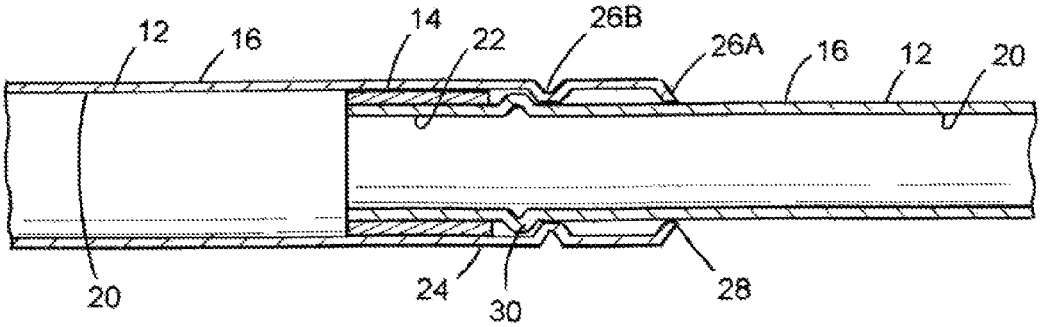
FIG. 11 is a cross-sectional view of the second embodiment hereof showing an inner tube and an outer tube from an adjacent pair of tubes, the inner and outer tubes being in an extended position.

As shown in the drawings, the second end 24 of at least one of the tubes 12 has at least two inwardly-oriented beads 26A,26B. The beads 26A,26B are a narrow ridge that is roll-formed around the circumference of the tube 12. As understood by those having ordinary skill in the metalworking arts, the bead 26 may be oriented inwardly toward the center point of the circular cross-section of the tube 12, or the bead 26 may be oriented outwardly away from the center point of the circular cross-section of the tube 12. One of the inwardly-oriented beads 26A is positioned at, or near, an end 28 of the second end 24 of the tube 12. Another one of the inwardly-oriented beads 26B is positioned on the second end 24 of the tube 12 but not on the end 28. Preferably the inwardly-oriented bead 26B is positioned at least 3 millimeters from the end 28 of the second end 24 of the tube 12. Even more preferably, this inwardly-oriented bead 26B is located about 5-15 millimeters from the end 28 of the second end 24 of the tube 12. As shown in FIG. 11, the inwardly-oriented beads 26A,26B have an inner circumferential surface 20 that is flush against the outer circumferential surface 16 of the adjacent telescoping tube 12.

According to this embodiment, the shim 14 is preferably at least 5 millimeters long, and even more preferably the shim 14 is about 7-18 millimeters long.

Figure 10:
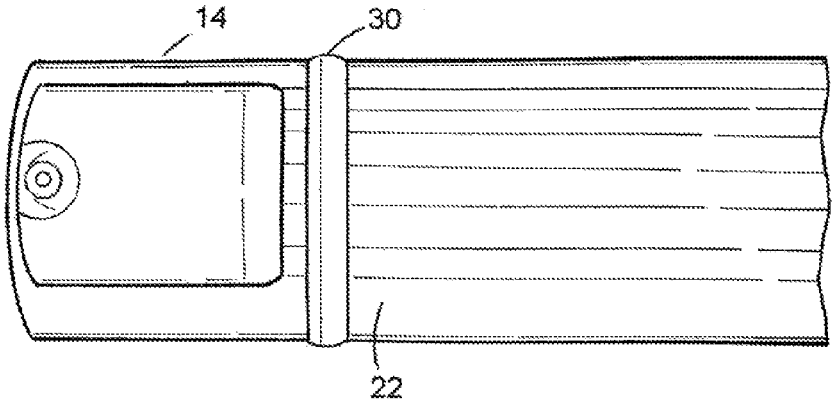
FIG. 10 is an enlarged view showing a first end of a tube having an outwardly-oriented bead.

Optionally, and as shown in FIG. 10, the first end 22 of at least one of the tubes 12 includes an outwardly-oriented bead 30. The outwardly-oriented bead 30 has an outer circumferential surface 16 that is preferably flush against the inner circumferential surface 20 of the adjacent telescoping tube 12.

When the tubes 12 are telescopically expanded, the inwardly-oriented bead 26B that is positioned away from the end 28 of the second end 24 of the tube 12 abuts the outwardly-oriented bead 30 on the first end 22 of the adjacent tube 12, as shown in FIG. 11. This abutment keeps the inner tube 12 in the adjacent pair from sliding all the way out of the outer tube 12. When the outwardly-oriented bead 30 is not provided, then the inwardly-oriented bead 26B abuts the shim 14 to keep the adjacent pair of tubes 12 from sliding apart.

As described above, the shim 14 is flush against the inner circumferential surface 20 of the outer adjacent tube 12, and the inwardly-oriented beads 26A,26B are flush against the outer circumferential surface 16 of the inner adjacent tube 12. These three points of contact provide a rigid joint between the adjacent tubes while the tubes 12 are telescopically extended.

Furthermore, the beading operations do not require any additional parts, they are quickly and easily added to the manufacturing process for each tube member, and they add no additional weight to the golf ball retriever.

As is apparent from the preceding, the present invention provides a telescoping handle for a golf ball retriever which is light, easy to manufacture, and requires few additional parts, yet which is structurally-reinforced so that it is sufficiently rigid while in an extended state.

What is claimed is:

1. A telescoping handle comprising:

(a) a plurality of telescoping hollow tubes, each tube having a first end, a second end, and an outer circumferential surface, the telescoping hollow tubes being nested within each other and being dimensioned to provide a gap between the adjacent pair of nested tubes;

(b) at least one shim secured to the outer circumferential surface of the first end of at least one of the tubes, the shim having a curvature to match the outer surface such that the shim and the outer surface are flush, the shim having a thickness sufficient to fill the gap between the adjacent pair of tubes whereby the shim is flush against the inner surface of the adjacent hollow tube; and (c) the second end of at least one of the tubes having at least two inwardly-oriented beads, each of the beads being positioned on the same tube and extending around a circumference of the tube, the beads further being spaced apart from one another along the length of the tube, a first one of the inwardly-oriented beads is positioned at a terminal end of the second end of the tube, and a second one of the inwardly-oriented beads is positioned on the second end of the tube but distanced from the terminal end, the inwardly-oriented beads having an inner circumferential surface that is flush against the outer circumferential surface of the adjacent telescoping tube.

2. The telescoping handle of claim 1 wherein the shim is at least 5 millimeters long.

3. The telescoping handle of claim 2 wherein the shim is about 7-18 millimeters long.

4. The telescoping handle of claim 2 wherein two shims are secured to the first end of at least one of the telescoping tubes, the two shims being evenly spaced about the outer circumference of the telescoping tube.

5. The telescoping handle of claim 1 wherein one of the inwardly-oriented beads is positioned about 5-15 millimeters from the end of the second end of the tube.

6. The telescoping handle of claim 1 wherein the first end of at least one of the tubes includes an outwardly-oriented bead, the outwardly-oriented bead has an outer circumferential surface that is flush against the inner circumferential surface of the adjacent telescoping tube.

7. The telescoping handle of claim 1 wherein two of the shims are secured to the first end of at least one of the telescoping tubes.

8. The telescoping handle of claim 7 wherein the shims are evenly spaced about the outer circumference of the telescoping tube.

9. The telescoping handle of claim 1 wherein the telescoping handle includes at least three telescoping tubes, the three telescoping tubes forming two pairs of adjacent nested tubes.

10. The telescoping handle of claim 1 wherein the shim has a cylindrical section that fully surrounds the outer circumference of the telescoping tube.

* * * * *